US006313860B1

(12) United States Patent
Suzuki et al.

(10) Patent No.: US 6,313,860 B1
(45) Date of Patent: Nov. 6, 2001

(54) LETTER PRINTING METHOD USING LINE THERMAL HEAD

(75) Inventors: Tomosaburo Suzuki; Masuo Sogabe, both of Tsurugashima (JP)

(73) Assignee: Daisey Machinery Co., Ltd., Tsurugashima (JP)

( * ) Notice: Subject to any disclaimer, the term of this patent is extended or adjusted under 35 U.S.C. 154(b) by 0 days.

(21) Appl. No.: 09/634,887

(22) Filed: Aug. 7, 2000

(30) Foreign Application Priority Data

Aug. 11, 1999 (JP) ..... 11-227233

(51) Int. Cl.[7] ..... B41J 33/54; B41J 33/56
(52) U.S. Cl. ..... 347/217
(58) Field of Search ..... 347/215, 217; 400/217, 225, 223

(56) References Cited

U.S. PATENT DOCUMENTS

| | | | | |
|---|---|---|---|---|
| 4,577,198 | * | 3/1986 | Hibino et al. | 347/215 |
| 4,606,661 | | 8/1986 | Aldrich et al. . | |
| 5,123,760 | | 6/1992 | Tsuru et al. . | |
| 5,649,774 | | 7/1997 | Harding et al. . | |
| 5,691,961 | | 11/1997 | Paranjpe . | |

FOREIGN PATENT DOCUMENTS

| | | | | |
|---|---|---|---|---|
| 2 778 143 | | 11/1999 | (FR) . | |
| 56-162684 | * | 12/1981 | (JP) | 400/217 |
| 62-244686 | * | 10/1987 | (JP) . | |
| 1-135662 | * | 5/1989 | (JP) . | |
| 1-157881 | * | 6/1989 | (JP) . | |
| WO 99/34983 | | 7/1999 | (WO) . | |

OTHER PUBLICATIONS

700 IBM Technical Disclosure Bulletin, vol. 31, No. 10, pp. 235–237, "Ribbon–Saving Technique for APA Printers", Mar. 1, 1989.

* cited by examiner

*Primary Examiner*—Huan Tran
(74) *Attorney, Agent, or Firm*—Oblon, Spivak, McClelland, Maier & Neustadt, P.C.

(57) ABSTRACT

Letter printing method using line thermal head relates to using ribbon tape effectively so as to cause no unused portion thereof. After one letter print (14) is done at letter printing position (12) of packaging material film (10) with the ribbon tape (30) being unwound, the ribbon tape (30) is rewound by length of the letter print (14). Simultaneously, the ribbon tape (30) is displaced in ribbon tape widthwise direction and next letter print (14) is done. Thereby, the letter print (14) may be done using entire width of the ribbon tape (30) with no unused portion being wasted.

2 Claims, 1 Drawing Sheet

LETTER PRINTING METHOD USING LINE THERMAL HEAD

BACKGROUND OF THE INVENTION

1. Field of the Invention

The present invention relates to a letter printing method for printing letters using a line thermal head and a ribbon tape.

2. Description of the Prior Art

When letters are printed on a packaging material film, such as a plastic film for packaging purpose, there is often employed a letter printing method using a line thermal head and a ribbon tape. In the letter print on the packaging material film, there are required many kinds of letter prints, including those of a laterally written form, longitudinally written form or the like, according to goods to be packaged. For example, in case of marking a tastable time period, there is a case where a lateral writing is done or a longitudinal writing is done relative to a running direction of the packaging material film in a packaging device according to design of a package or arrangement of an ornamental pattern applied.

On the other hand, while the ribbon tape used for the letter print has usually a width of about 60 mm, in case this ribbon tape is used for printing letters, for example, for printing one line of the tastable time period, longitudinally, only a small part of the widthwise directional portion of the ribbon tape is used and then already the ribbon tape will be wound around a reel which is for winding the ribbon tape after used. The ribbon tape is one of highly expensive consumables and it will be very uneconomical if the ribbon tape is abandoned with only the small part of the entire width having been used.

SUMMARY OF THE INVENTION

It is therefore an object of the present invention to provide a letter printing method using a line thermal head for effecting a letter print by using a ribbon tape effectively so as to cause no unused portion of the ribbon tape.

It is also an object of the present invention to provide a letter printing method for effecting a letter print by using a ribbon tape effectively for either case of a lateral writing and a longitudinal writing.

In order to attain the mentioned objects, the present invention provides a letter printing method including after one letter print is done with the ribbon tape being unwound, rewinding the ribbon tape by a length of the letter print as well as displacing the ribbon tape in a widthwise direction of the ribbon tape; and effecting a next letter print using an unused portion of the ribbon tape in the widthwise direction of the ribbon tape.

In the letter printing method of the present invention, in order to displace the ribbon tape in the widthwise direction thereof, a letter printing mechanism including the line thermal head may be displaced together with the ribbon tape in the widthwise direction of the ribbon tape. That is, in the letter print using the line thermal head and ribbon tape, a position used for the letter print in the line thermal head may be changed by changing a ribbon tape heating position in the line thermal head in the widthwise direction of the ribbon tape.

In the letter printing method of the present invention, the ribbon tape after used for one letter print is rewound by the length of the letter print as well as is displaced in the widthwise direction of the ribbon tape and the next letter print is done using the unused portion in the widthwise direction of same, thereby the ribbon tape may be used in the entire width thereof for the letter print. Thus, according to the present invention, the letter print may be done effectively using the entire width of the ribbon tape so as to cause no unused portion of the ribbon tape.

DESCRIPTION OF THE PREFERRED EMBODIMENT

Figure 1:
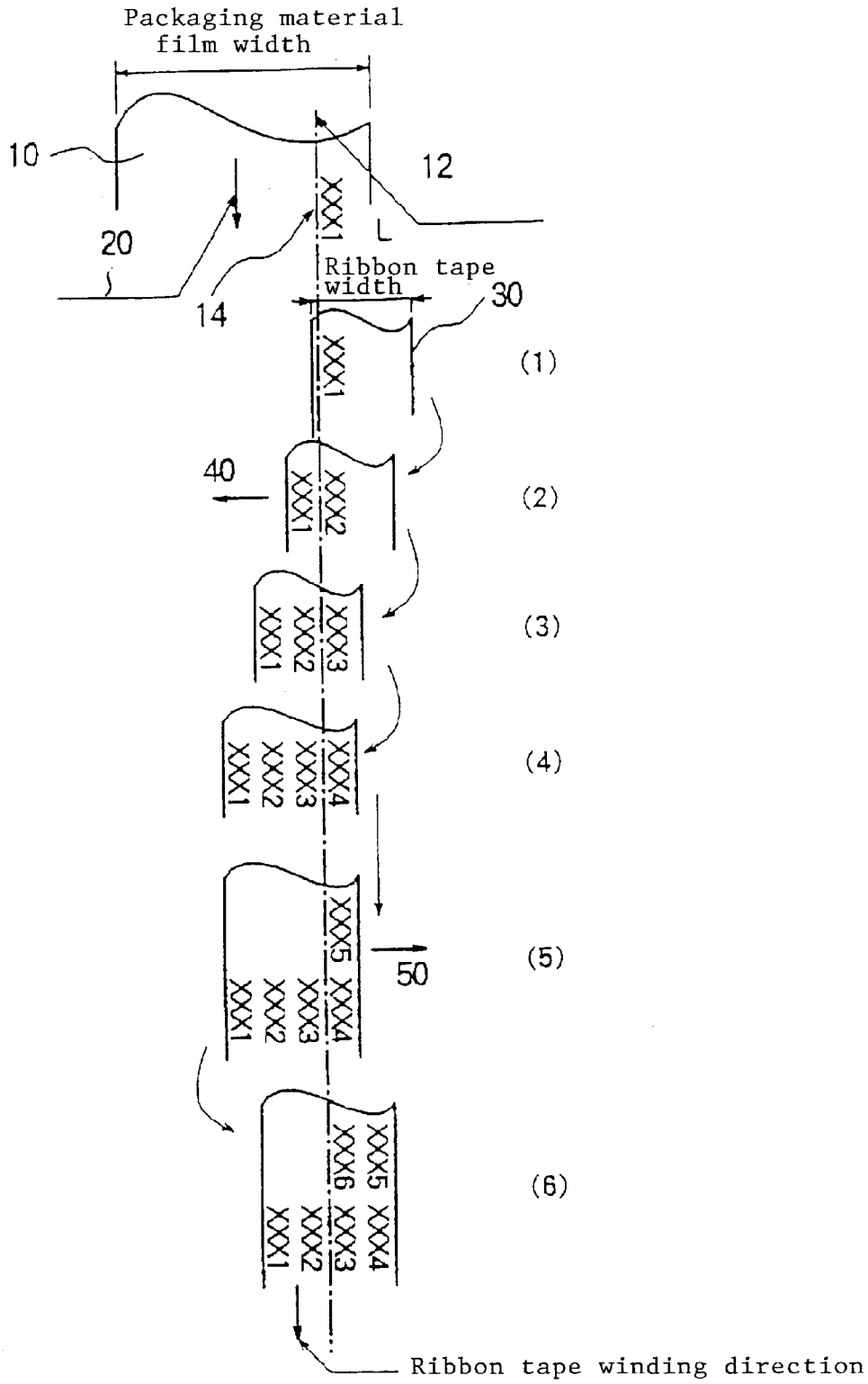
FIG. 1 is an explanatory view showing in time series an embodiment of a letter printing method according to the present invention.

Herebelow, an embodiment of a letter printing method according to the present invention will be described concretely with reference to a figure. FIG. 1 is an explanatory view showing in time series an embodiment of a letter printing method according to the present invention, wherein, while a packaging material film as an object to be printed is running in a film running direction, movement of a ribbon tape in the film running direction to move to a letter printing position of the packaging material film and displacement of the ribbon tape in a ribbon tape widthwise direction are shown in time series.

In FIG. 1, numeral 10 designates a packaging material film, which is made of a plastic material to be used for packaging. The packaging material film 10 is transferred in a film running direction, as shown by arrow 20, and a letter print 14 is done on the packaging material film 10 at a letter printing position 12 which appears with a predetermined interval between each of the letter printing positions 12 as the packaging material film 10 runs in the film running direction 20. The letter prints 14 on the packaging material film 10 are done in a longitudinal writing, in the letter printing positions 12 in a constant line on the packaging material film 10.

A ribbon tape 30 used for the letter print has a width shown by L and the letter print is done on a small part of the entire width L. FIG. 1 shows a mode in which the letter print is done six times of (1) to (6) sequentially on the packaging material film 10 so that the packaging material film 10 is applied with six letter prints 14 with the predetermined intervals between them in the film running direction 20. Each of the letter prints 14 is expressed by a mark "XXX-n"wherein n shows an order of the letter print 14.

Firstly, the letter print 14 of XXX1 on the packaging material film 10 is done on one end portion in the widthwise direction of the ribbon tape 30 (the left hand end of the ribbon tape in FIG. 1). At this time, the ribbon tape 30 is unwound to be fed in the film running direction 20. When the letter print 14 of XXX1 is finished, the ribbon tape 30 is returned to be rewound by a length which has been fed for the letter print 14 of XXX1 and, at the same time, is displaced to the widthwise direction shown by arrow 40 by a widthwise length of the letter print 14.

As for the mentioned displacement of the ribbon tape 30 in the direction of arrow 40, it can be done by displacing an entire portion of a printing device or by displacing the ribbon tape together with a main portion of a printing mechanism including a line thermal head. By so rewinding the ribbon tape 30 and displacing it in the direction of arrow 40 by the widthwise length of the letter print, the next letter print 14 of XXX2 can be done on the packaging material film 10 at the next letter printing position 12. This state is shown in (2) of FIG. 1. While the letter print 14 of XXX2 is being done, the ribbon tape 30 is fed in the film running direction 20 by the length of the letter print. When the letter print 14 of XXX2 is finished, the ribbon tape 30 is rewound by the length of the letter print as well as is displaced in the direction of arrow 40 by the widthwise length of the letter print and the next letter print 14 of XXX3 is done. This state is shown in (3) of FIG. 1.

Likewise, the next letter print 14 of XXX4 is done and when it is finished, the ribbon tape 30 becomes a state that the entire width thereof has been used for the letter print, as shown in (4) of FIG. 1.

When the ribbon tape 30 comes to the state that the entire width thereof has been used for the letter print, the ribbon tape 30 is not rewound but the next letter print 14 of XXX5 is done by using a next new area of the ribbon tape 30 in the lengthwise direction. This state is shown in (5) of FIG. 1. When the letter print 14 of XXX5 is finished, while the ribbon tape 30 is rewound by the length of the letter print, the displacement of the ribbon tape 30 in the widthwise direction by the widthwise length of the letter print is done in the direction of arrow 50, which is reverse to the direction of arrow 40, as shown in (5) of FIG. 1. Then, the next letter print 14 of XXX6 is done.

Thereafter, the feeding and rewinding of the ribbon tape 30 as well as the displacing thereof in the widthwise direction by the widthwise length of the letter print are repeated likewise, so that the letter print is continued with the entire face of the ribbon tape 30 being used without waste. The mentioned feeding and rewinding of the ribbon tape 30 as well as the displacing thereof in the widthwise direction may be done easily by setting a sequence using an appropriate mechanism.

It is to be noted that while the embodiment as illustrated has been described with respect to the case where the letter print is done four times in the widthwise direction of the ribbon tape 30, where a width of the letter print of one time is 1/a of an effective letter print width of the line thermal head used for the letter print or 1/b of a width of the heat transfer ribbon tape used for the letter print, the letter print can be done b times, if a is b or more ($a \geqq b$), or a times, if a is b or less ($a \leqq b$), using an unused area of the ribbon tape in the widthwise direction while the ribbon tape is rewound repeatedly (variables a, b are natural numbers).

While the invention has been described concretely based on the embodiment as illustrated, the invention is not limited to the described embodiment but, needless to mention, may be added with various modifications in the particular structure and construction thereof as come within the scope of the appended claims.

For example, while, in the embodiment, the letter print is done with the ribbon tape 30 being displaced while reciprocating in the widthwise direction, the letter print may be done only on one way of the displacement movement of the ribbon tape with no letter print being done on the other way.

Also, while in the embodiment, only the case where the letter print 14 is done in the longitudinal writing in the film running direction 20 of the packaging material film 10 has been described, it will be preferable if the construction is made such that a mode of the letter print is changeable according to selection so that the letter print may be done also in the lateral writing using the entire width of the ribbon tape 30 without the ribbon tape 30 being rewound and displaced in the widthwise direction.

As described above, the present invention provides the letter printing method using the line thermal head, comprising steps of; after one letter print is done with the ribbon tape being unwound, rewinding the ribbon tape by the length of the letter print as well as displacing the ribbon tape in the widthwise direction of the ribbon tape; and effecting the next letter print using the unused portion of the ribbon tape in the widthwise direction of the ribbon tape.

According to the letter printing method of the present invention, the ribbon tape after used for one letter print is rewound by the length of the letter print as well as is displaced in the widthwise direction of the ribbon tape and the next letter print is done using the unused portion in the widthwise direction of same, thereby the ribbon tape may be used in the entire width thereof for the letter print. Thus, according to the present invention, the letter print may be done effectively using the entire width of the ribbon tape so as to cause no unused portion of the ribbon tape.

What is claimed is:

1. A letter printing method using a line thermal head for effecting a letter print on an object to be printed with a ribbon tape being unwound in a same direction as a transfer direction of said object to be printed, said letter printing method comprising the steps of:

after one letter print is done, rewinding said ribbon tape by a length of said letter print; and effecting a next letter print on a letter printing position of said object on a constant line in said transfer direction using an unused portion of said ribbon tape in a widthwise direction of said ribbon tape with said line thermal head being displaced relative to said object together with said ribbon tape in the widthwise direction of said ribbon tape.

2. A letter printing method using a line thermal head for effecting a letter print on an object to be printed with a ribbon tape being unwound in a same direction as a transfer direction of the object to be printed, said letter printing method comprising the steps of:

providing a letter printing mechanism including a line thermal head having a plurality of heating portions configured to press and heat the ribbon tape;

printing one letter print using the ribbon tape with one of the plurality of heating portions in the line thermal head;

rewinding the ribbon tape by a length of the one letter print;

displacing the ribbon tape and the letter printing mechanism including the line thermal head together in a widthwise direction of the ribbon tape relative to said object; and printing a next letter print on a letter printing position of said object on a constant line in said transfer direction using an unused portion of the ribbon tape in the widthwise direction of the ribbon tape with a respective one of the plurality of heating portions in the line thermal head.

* * * * *